United States Patent [19]

Cohn

[11] Patent Number: 4,898,149

[45] Date of Patent: Feb. 6, 1990

[54] CORD-CONNECTED HOOD-BACKSPLASH

[76] Inventor: Martin B. Cohn, 25 Oxford Pl., Rockville Centre, N.Y. 11570

[21] Appl. No.: 364,972

[22] Filed: Jun. 12, 1989

[51] Int. Cl.[4] ..... F24C 15/20
[52] U.S. Cl. ..... 126/299 R
[58] Field of Search ..... 126/299 R, 299 C, 299 D, 126/299 E

[56] References Cited

U.S. PATENT DOCUMENTS 2,487,607 11/1949 Sonntag ..... 126/299 D
4,766,881 8/1988 Pax ..... 126/299 R

*Primary Examiner*—Carroll B. Dority

[57] ABSTRACT

A cord-connected ductless range hood and backsplash. A bracket is mounted on a wall. The product is mounted on the bracket so that the backsplash is vertical and the hood is horizontal. The hood mounts lights and a fan and an electrical cord extends from behind the bottom of the backsplash. Internal wiring passes through the bracket.

1 Claim, 2 Drawing Sheets

FIG. 3A
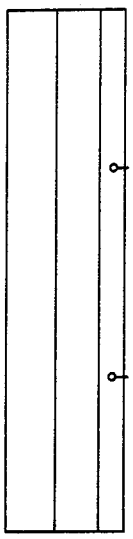
FIG. 3
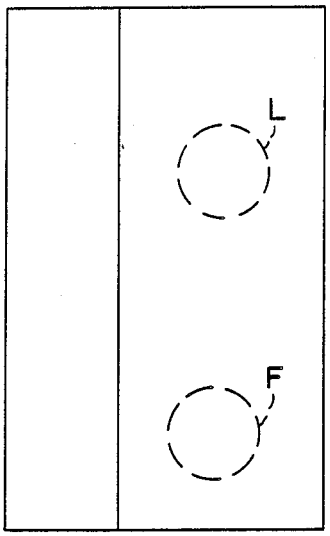
FIG. 4
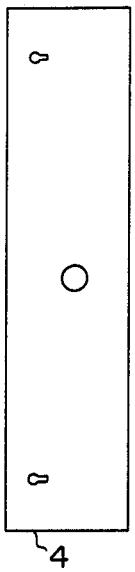
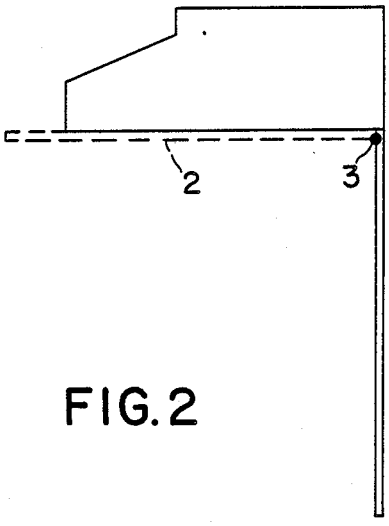
FIG. 2

CORD-CONNECTED HOOD-BACKSPLASH

This invention relates to hoods for cooking ranges and, more particularly, to a hood which can be connected to electricity with an electrical cord.

BACKGROUND

Cooking ranges generally require a hood, which requires electricity to supply light and fan. This electrical connection is generally made through the kitchen wall and requires the services of an electrician to install connection boxes, etc.

The present invention provides a hood assembly which may be plugged into the nearest electrical socket so that the homeowner may install the hood himself without the expense of hiring a licensed electrician.

THE INVENTION

The invention is a cord-connected range hood. A mounting bracket by conventional means is mounted on the wall behind the stove. The hood, having light and fan, is preassembled as one piece with a backsplash which protects the wall. This assembly is designed to slide onto the mounting bracket. An electric Line Cord which supplies the electricity to the light and fan exits from behind the bottom of the backsplash, and is concealed by the backsplash.

OBJECTS OF THE INVENTION

A principal object of the invention is to provide a new and improved range-hood, having an electrical supply for lights and fan.

Another object of the invention is to provide a new and improved range-hood, having an electrical supply for lights and fan, whereby an electric cord may be connected to the lights and fan and extend downwardly behind the back splash so that it can be plugged into the nearest electrical socket.

These, and other objects of the invention, will be apparent from the following specifications and drawings, of which FIG. 1 is a perspective view of an embodiment of the invention.

FIG. 2 is a side view of FIG. 1.

FIG. 3 is an exploded top view of FIG. 2 showing bracket 4.

FIG. 3A is a partial front view of FIG. 3.

FIG. 4 is a partial rear view of FIG. 3.

Figure 1:
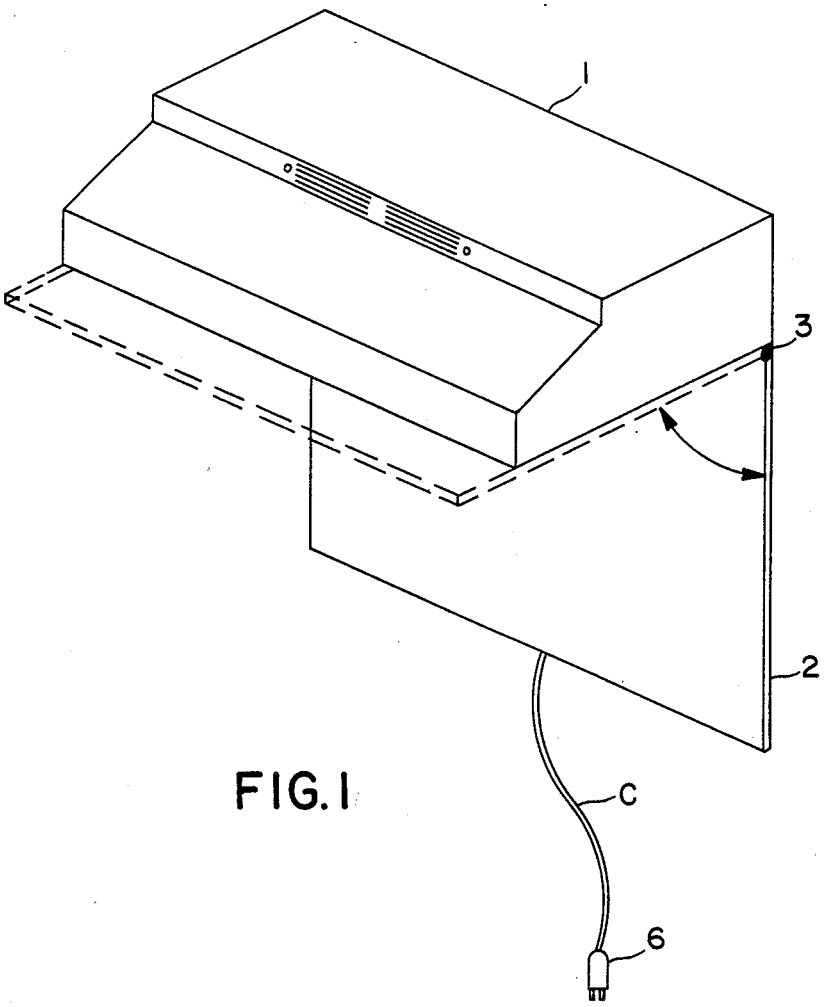

Referring to the drawings, the hood 1 and splash pan 2 are hinged by a hinge 3 so that the back splash 2 can be folded to the dotted line position for shipping.

The hood 1 contains lights and fan, which require a supply of electricity.

The hood assembly is installed as follows:

A bracket 4, FIG. 5, is mounted on the wall. The hood-backsplash 2, is then mounted on the bracket so that it fits closely against the wall.

The electricity for the light L and fan F is provided by the electrical cord C, which extends down behind the back splash 2. The cord has a conventional plug 6, which may be plugged into the nearest electrical outlet.

Therefore, the present invention may be installed easily by the homeowner without requiring the services of a licensed electrician.

This invention has been approved by Underwriters Laboratories Inc.

The light and fan have conventional on/off switches, not shown.

It is claimed:

1. A cord connected ductless range-hood, fan and backsplash comprising:

a bracket adapter to be mounted on a wall, a range hood/backsplash adapted to be mounted on the bracket so that the hood is horizontal and the backsplash is hinged to the hood and vertical, the hood being adapted to mount a light and a fan, internal wiring for the light and for passing from the hood through the bracket, and a line cord connected to the internal wiring exiting from behind the bottom of the backsplash.

* * * * *